US010161208B2

(12) United States Patent
Baudoin

(10) Patent No.: US 10,161,208 B2
(45) Date of Patent: Dec. 25, 2018

(54) DRILL STRING PRESSURE ALTERING APPARATUS AND METHOD

(71) Applicant: KLX ENERGY SERVICES LLC, Houston, TX (US)

(72) Inventor: Toby Scott Baudoin, Rayne, LA (US)

(73) Assignee: KLX Energy Services LLC, Houston, TX (US)

( * ) Notice: Subject to any disclaimer, the term of this patent is extended or adjusted under 35 U.S.C. 154(b) by 108 days.

(21) Appl. No.: 15/182,993

(22) Filed: Jun. 15, 2016

(65) Prior Publication Data

US 2016/0369583 A1 Dec. 22, 2016

Related U.S. Application Data

(60) Provisional application No. 62/180,267, filed on Jun. 16, 2015.

(51) Int. Cl.

| | |
|---|---|
| ***E21B 28/00*** | (2006.01) |
| ***E21B 31/00*** | (2006.01) |
| ***E21B 7/24*** | (2006.01) |

(52) U.S. Cl.

CPC ..... *E21B 28/00* (2013.01); *E21B 7/24* (2013.01); *E21B 31/005* (2013.01)

(58) Field of Classification Search

CPC ..... E21B 28/00; E21B 7/24; E21B 31/005
See application file for complete search history.

(56) References Cited

U.S. PATENT DOCUMENTS

| | | | |
|---|---|---|---|
| 3,168,140 | A | 2/1965 | Bodine, Jr. |
| 4,384,625 | A | 5/1983 | Roper et al. |
| 4,429,743 | A | 2/1984 | Bodine |
| 4,568,249 | A | 2/1986 | Todd |
| 4,890,682 | A | 1/1990 | Worrall et al. |
| 5,467,322 | A | 11/1995 | Walter |
| 6,024,540 | A | 2/2000 | Navarro Bonet |
| 6,152,222 | A | 11/2000 | Kyllingstad |
| 6,907,927 | B2 | 6/2005 | Zheng et al. |
| 7,059,426 | B2 | 6/2006 | Walter |
| 7,066,250 | B2 | 6/2006 | Webb et al. |
| 8,272,404 | B2 | 9/2012 | Brunskill et al. |
| 9,091,123 | B2 | 7/2015 | Gust |
| 9,109,411 | B2 | 8/2015 | Shampine et al. |
| 2002/0157871 | A1 | 10/2002 | Tulloch |

(Continued)

OTHER PUBLICATIONS

PCT Search Report and Written Opinion issued for related application PCT/US2016/037564, dated Oct. 24, 2016, 11 pages.

*Primary Examiner* — Brad Harcourt

(74) *Attorney, Agent, or Firm* — Drinker Biddle & Reath LLP

(57) ABSTRACT

An apparatus for creating vibrations in a pipe string is disclosed. The device comprises a fluid pump which pumps fluid within a first fluid bore and is connected to the pipe string. A hydraulic pump pumps fluid within a second fluid bore and a movable plunger disposed between the first fluid bore and the second fluid bore intermittently opens and closes access to a tank based on changes to a pressure of the fluid pump. The tank for collecting at least a portion of the fluid is connected to the apparatus via the first fluid bore, and the movement of the plunger is configured to generate vibrations within the pipe string by altering the amount of fluid allowed to flow to the tank.

9 Claims, 6 Drawing Sheets

(56) References Cited

U.S. PATENT DOCUMENTS

| | | | | |
|---|---|---|---|---|
| 2003/0016164 | A1* | 1/2003 | Finke | E21B 47/185 342/83 |
| 2005/0236190 | A1 | 10/2005 | Walter | |
| 2005/0284624 | A1 | 12/2005 | Libby et al. | |
| 2014/0246234 | A1 | 9/2014 | Gillis et al. | |
| 2015/0300153 | A1 | 10/2015 | MacDonald et al. | |
| 2015/0354307 | A1 | 12/2015 | Baudoin | |

* cited by examiner

DRILL STRING PRESSURE ALTERING APPARATUS AND METHOD

CROSS REFERENCES TO RELATED APPLICATIONS

The present application claims the benefit of U.S. Provisional Application No. 62/180,267, entitled "DRILL-STRING PRESSURE ALTERING APPARATUS AND METHOD," and filed on Jun. 16, 2015, which is incorporated herein by reference in its entirety.

FIELD OF THE DISCLOSURE

The present disclosure generally relates to surface equipment for oil and gas wells and, more particularly, a method and apparatus for altering pressure to create vibrations in a pipe or tubing string, thereby reducing the coefficient of friction between the pipe string and the wellbore.

BACKGROUND

During the advancement or manipulation of a pipe string in a wellbore such as a drill string or a coil tubing string, it is often prudent to jar, vibrate, or oscillate the pipe string. This vibration aids in overcoming frictional forces between the pipe string and the interior surface of the wellbore. Conventional systems employ various types of vibrators with pipe strings to provide vibration, and are usually included in the bottom hole assemblies, thus operating in the wellbore. These types of vibrators create pressure pulses from the end of the pipe or coil tubing string that travel upwards towards the surface.

However, such conventional systems pose certain drawbacks. The amplitude of the pressure pulses may diminish as they travel from the source of the creation. That is, pressure pulses created from a downhole apparatus are very faint or non-existent at the surface. Additionally, the friction reduction provided by the vibrations also diminishes towards the surface. Also, with respect to Bottom Hole Assemblies (BHAs), generally only one downhole vibration apparatus may be used at a time due to operational or length restrictions. Therefore, a redundant vibration apparatus may not be used in case of failure of the primary vibration apparatus.

DRAWINGS

While the appended claims set forth the features of the present techniques which may be best understood from the following detailed description taken in conjunction with the accompanying drawings of which:

DETAILED DESCRIPTION

Figure 1:
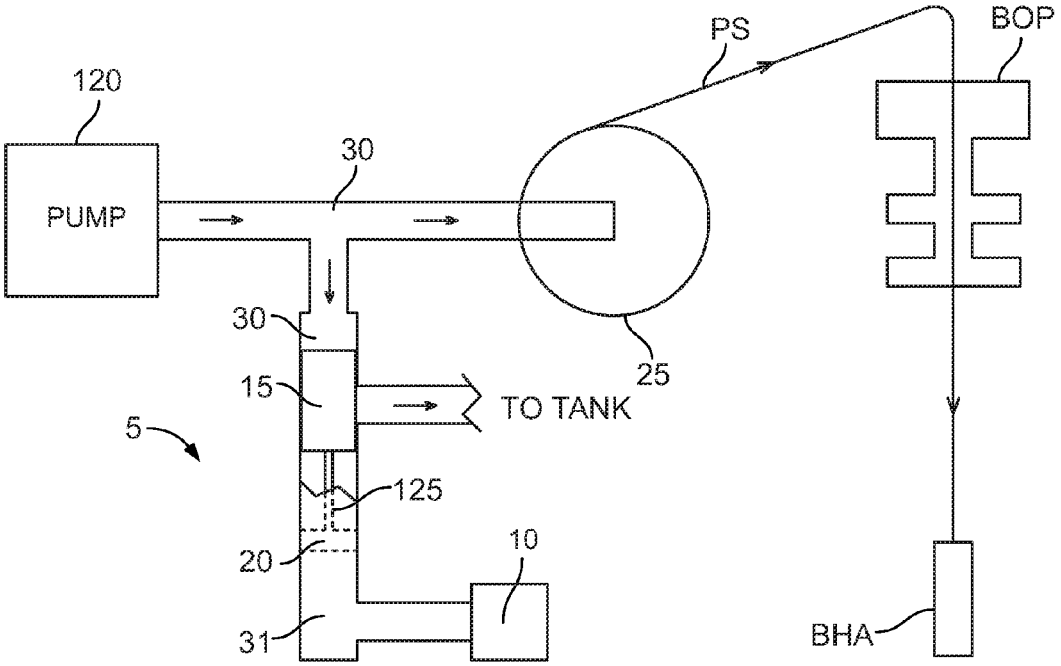
FIG. 1 illustrates a pressure altering apparatus, configured according to a first embodiment.

The following discussion is directed to various exemplary embodiments. However, one possessing ordinary skill in the art will understand that the examples disclosed herein have broad application, and that the discussion of any embodiment is meant only be exemplary of that embodiment, and not intended to suggest that the scope of the disclosure, including claims, is limited to that embodiment.

Certain terms are used throughout the following description to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

As discussed above, there is a need for a pump pressure altering apparatus that will serve to induce vibration created from the surface while allowing for redundant or secondary systems. According to various embodiments of a pressure altering apparatus described herein, the pressure altering apparatus operates on the surface and in conjunction with the fluid pump, thereby creating pressure pulses which travel from the surface downward toward the end of the pipe or coil tubing string.

In an embodiment, a pressure altering apparatus is used to create vibrations that satisfy the aforementioned needs. The pump being described may be a triplex mud pump, according to an embodiment. However, a person skilled in the art would understand that the pump may be of any form and having at least two plungers. Altering pressures to create these vibrations may be achieved by increasing or decreasing the pressure according to various embodiments. A person possessing ordinary skill in the art will understand the term "pump pressure" is used to mean the pressure in the fluid stream on the discharge side of the pump (or between the pump and the pipe string). This fluid may be a liquid, gas, or a combination thereof.

Increasing pump pressure (flowing fluid pressure) requires either pumping a higher fluid flow rate through a given cross sectional flow area, or reducing the cross sectional flow area for a given fluid flow rate. Decreasing the flowing fluid pressure requires either pumping a lower fluid flow rate through a given cross sectional flow area, or increasing the cross sectional flow area for a given fluid flow rate. A vibration is created when each of these pressure changes occur during a given period of time. Vibrations are commonly defined by three attributes: amplitude, duration, and frequency. The amplitude is the magnitude or amount of vibration energy or pulse. The duration is the length of time each pressure change takes, whether it is an increase or decrease. The frequency is the number of pressure changes per unit of time (typically measured in Hertz, or cycles per second). The amplitude, duration, and frequency of the pressure change (pulse) may be controlled and effect the reduction of frictional forces between the pipe string and wellbore.

The effect of increasing and or decreasing the flowing fluid pressure in a drill string is similar to placing a kink in a water hose, then suddenly releasing the kink in a repeated fashion. Another example is the pulse created in a water pipe due to the opening and closing of a water faucet. If the faucet is suddenly closed, a pressure wave or surge in the fluid in the pipe (due to the sudden stopping of the weight of the fluid stream) will vibrate and rattle the pipe. This phenomenon is sometimes called the "fluid hammer effect". The pressure altering apparatus disclosed herein does not completely close or shut off the fluid flow as in the examples above, but does alter the available flow area, and as a result the flowing pressure, enough to cause a similar vibration effect within the pipe string (whether drill pipe, conventional tubing, or coil tubing), according to various embodiments described herein.

In drilling or workover operations, the fluid flow to the pipe string must not be completely closed while pumping operations are ongoing as this can cause an unsafe pressure increase in the pipe string. If pressure increases are used to create the vibration, these increases must be managed carefully. The pressure on the pumps and associated piping must remain within manufacturer's specifications.

In an embodiment, the pressure altering apparatus creates vibrations in a pipe string. The apparatus is disposed on a surface side of the pipe string and includes a fluid pump configured to pump fluid within a first fluid bore, the fluid pump being connected to the pipe string via the first fluid bore. The apparatus further includes a hydraulic pump configured to pump fluid within a second fluid bore and a movable plunger disposed between the first fluid bore and the second fluid bore, and configured to alter a pressure of fluid within the first fluid bore based on changes to a pressure of the fluid pump. A tank for collecting at least a portion of the fluid is connected to the apparatus via the first fluid bore and the movement of the plunger is configured to generate vibrations within the pipe string via the first fluid bore by altering the amount of fluid allowed to flow to the tank.

According to another embodiment of the pressure altering apparatus, the apparatus comprises a fluid pump configured to pump fluid within a first fluid bore where the fluid pump is connected to the pipe string via the first fluid bore. A stationary valve plate is disposed within the first fluid bore to seal the first fluid bore, a rotating valve plate is disposed within the second fluid bore and is connected to a motor, and a motor is configured to rotate the rotating valve plate. A tank connected to the apparatus is disposed below the rotating valve plate for collecting at least a portion of the fluid and the rotation of the rotating valve plate is configured to intermittently allow fluid to flow to the tank to generate vibrations within the pipe string via the first fluid bore.

According to yet another embodiment of the pressure altering apparatus, the apparatus comprises a fluid pump configured to pump fluid within a first fluid bore, a stationary valve plate disposed within the first fluid bore, a rotating valve plate disposed within the first fluid bore, and a motor connected to the rotating valve plate and configured to rotate the rotating valve plate, where the pipe string is connected between the motor and the rotating valve plate. The rotation of the rotating valve plate is configured to intermittently allow fluid to flow within the pipe string to generate vibrations within the pipe string.

According to another embodiment, a pressure altering apparatus comprises a primary fluid pump configured to pump fluid within the pipe string via a first fluid bore, a secondary fluid pump configured to pump fluid within the pipe string via a second fluid bore, a first valve configured to control the flow of the fluid from the secondary fluid pump to the pipe string, and a second valve configured to control the flow of the fluid from the secondary fluid pump to a tank. The tank is configured to collect at least some of the fluid pumped by the secondary pump via the second fluid bore, and the first valve and the second valve are alternatively opened and closed to generate vibrations in the pipe string.

According to another embodiment, an apparatus for creating vibrations in a pipe string is disclosed. The apparatus is disposed on a surface side of the pipe string and includes a plunger style fluid pump for pumping fluid into a pipe string, where the plunger style pump has more than one plunger. Each of the plunger has differing diameters, where the volume of fluid pumped by each plunger is different causing pressure fluctuations in the fluid stream and therefore creating vibrations in the pipe string.

Turning now to FIG. 1, a pressure altering apparatus 5 according to a first embodiment is illustrated. The pressure altering apparatus 5 uses a hydraulic pump 10 along with a plunger 15 movable within a first fluid bore 30 to create pressure alterations in the fluid stream from the fluid pump 120. Moreover, the first fluid bore 30 is connected to a pipe string PS via a tubing reel 25 as shown in FIG. 1. As further illustrated in FIG. 1, the pipe string PS is extended into the BHA. One or more blowout preventers (BOP) may be provided. According to an embodiment, the blowout preventer (BOP) may be a large, specialized valve or similar mechanical device, used to seal, control and monitor oil and gas wells to prevent blowout. A plunger 15 may be sealed within the bore 30 so that fluid from the fluid pump 120 may not travel around it. The shaft 125 connects the plunger 15 to a piston 20. The piston 20 may be sealed within a second fluid bore 31 in the embodiment. As pressure from the hydraulic pump 10 increases, the piston 20 may be forced upwards, thus disallowing fluid from the fluid pump 120 to be circulated back into the tank and increasing pressure within the pipe string. As pressure from the hydraulic pump 10 decreases, the pressure from the fluid pump 120 may force the plunger 15 downwards, thus allowing fluid to be circulated back to the tank. According to the embodiment, this results in a sudden pressure drop within the pipe string. These sudden pressure surges create pulses or vibrations within the pipe string causing it to rattle, according to an embodiment. This reduces the friction of the pipe string within the wellbore, thereby allowing it to travel more freely into the wellbore. A person having ordinary skill in the art will understand that the frequency at which the plunger 15 strokes may be set by controlling the output of the hydraulic pump 10.

Figure 2:
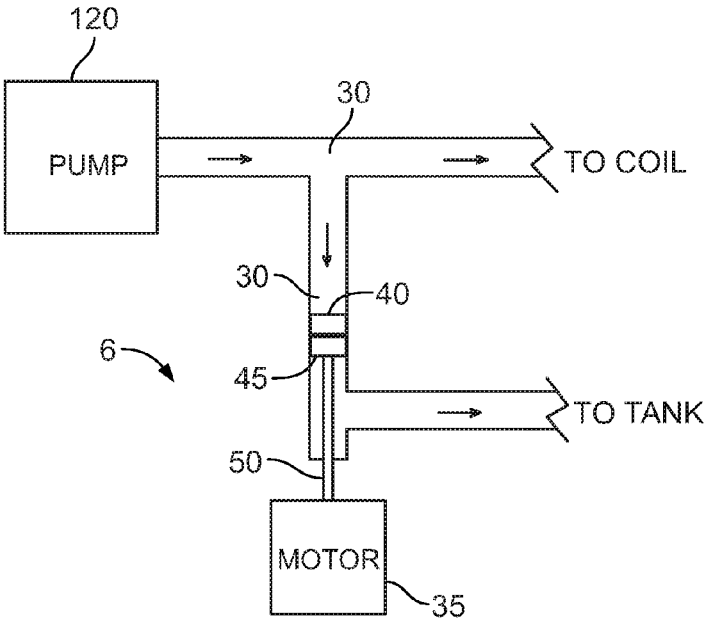
FIG. 2 illustrates a pressure altering apparatus, configured according to a second embodiment.
Figure 3:
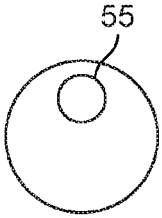
FIG. 3 is a front view of the valve plates of FIG. 2 shown in an open position, according to a first embodiment of the valve plates.
Figure 4:
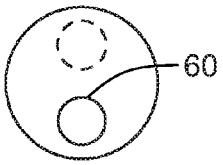
FIG. 4 is a front view of the valve plates of FIG. 2 shown in a closed position, according to the first embodiment of the valve plates.

FIG. 2 illustrates a second embodiment of a pressure altering apparatus 6 that uses a motor 35 along with a set of valve plates 40 and 45 to create pressure changes within the pipe string by altering the fluid flow in a secondary fluid stream. A skilled artisan would appreciate that the motor described herein may be any type of hydraulic, electric, or other type of motor that creates a rotational movement upon shaft 50. Stationary valve plate 40 is sealed within the bore 30. The rotating valve plate 45 is attached to the shaft 50 which is constantly rotating with respect to the motor 35. As the rotating valve plate 45 rotates, openings 55 and 60 are intermittently aligned and misaligned. Consequently, there are instances at which the openings 55 and 60 are completely aligned, partially aligned, or not at all aligned with one another. FIG. 3 illustrates an instance where the openings 55 and 60 are completely aligned with each other. The resistance to fluid flow from the fluid pump 120 is at its minimum and fluid travels most freely through the pressure altering apparatus 6 at this instance. As the rotating valve plate 45 continues to rotate relative to the stationary valve plate 40, openings 55 and 60 become completely misaligned, thus substantially blocking fluid flow, as illustrated in FIG. 4. At that instance, the resistance to the flow of fluid through the apparatus is at its greatest.

This cyclical process, where there is only intermittent alignment of openings 55 and 60, provides a resulting increase and decrease of resistance to the flow of fluid through the pressure altering apparatus 6, thereby creating pulses within the fluid column in the pipe string. This is sometimes called hydraulic shock. These pulses in the fluid column cause the pipe string to vibrate or oscillate. These vibrations may travel the full length of the pipe string. The motor may operate at any speed (RPM) thus creating the desired frequency.

A person possessing ordinary skill in the art will understand that the openings 55 and 60 may be varied by number, size, shape, or orientation, and by any permutation thereof to provide for adjustment of the amplitude, duration, and frequency of the fluid pulses in the column of fluid in the central bore of the pipe string and the vibration of the pipe string.

Figure 5:
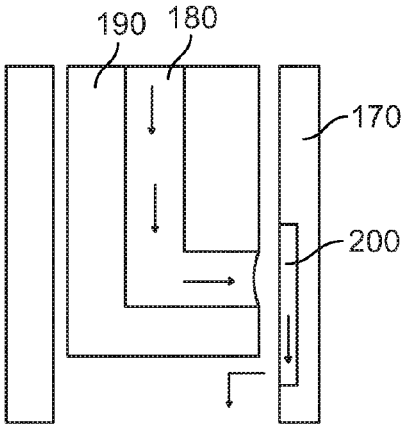
FIG. 5 is a front view of the valve plates of FIG. 2 shown in an open position, according to a second embodiment of the valve plates.
Figure 6:
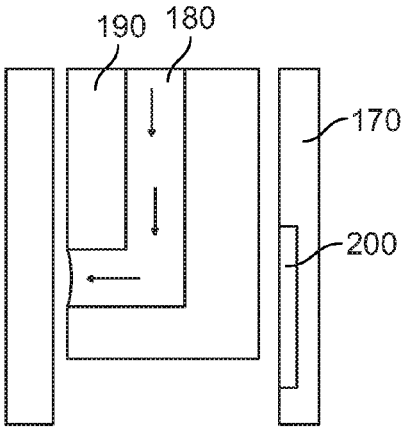
FIG. 6 is a front view of the valve plates of FIG. 2 shown in a closed position, according to the second embodiment of the valve plates.
Figure 7:
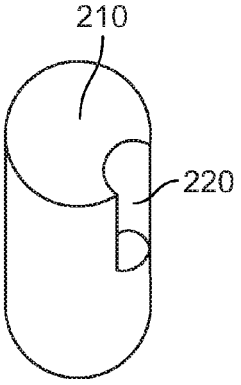
FIG. 7 is a front view of one of the valve plates of FIG. 2, according to a third embodiment of the valve plates.

FIG. 5 illustrates an alternative embodiment of the valve plates 40 and 45 where one member is substantially a cylinder 190 and the other member is a tube 170. In this embodiment, the cylinder 190 is the rotating member and the tube 170 is the stationary member. As illustrated in FIG. 5, fluid is allowed to travel through a flow path 180 through the cylinder 190 and into a recess 200 in the tube 170, thus forcing the valve in an open position. Alternatively, the valve is positioned in the closed position as illustrated in FIG. 6. FIG. 7 shows an alternative embodiment of one of the valve plate members 210, where the valve place member 210 have a recess 220.

Figure 8:
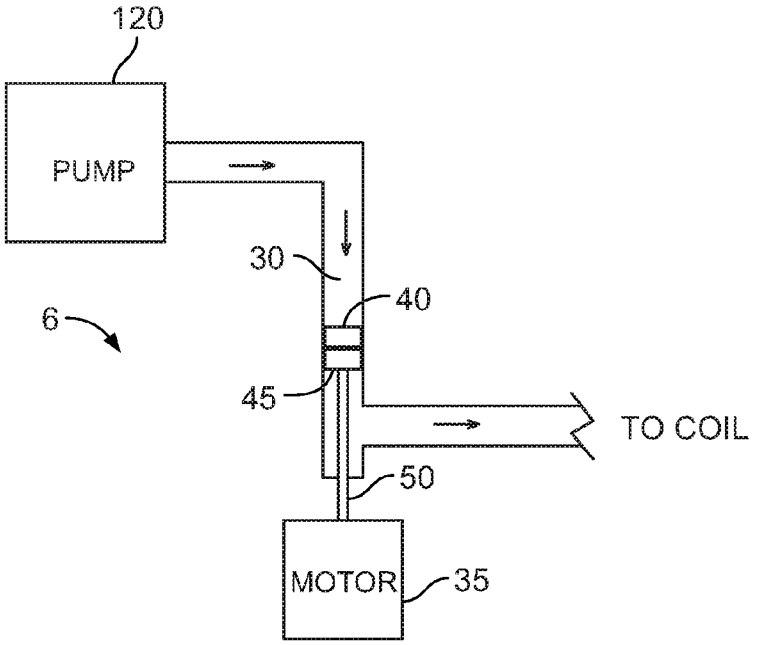
FIG. 8 illustrates a pressure altering apparatus, configured according to a third embodiment.
Figure 9:
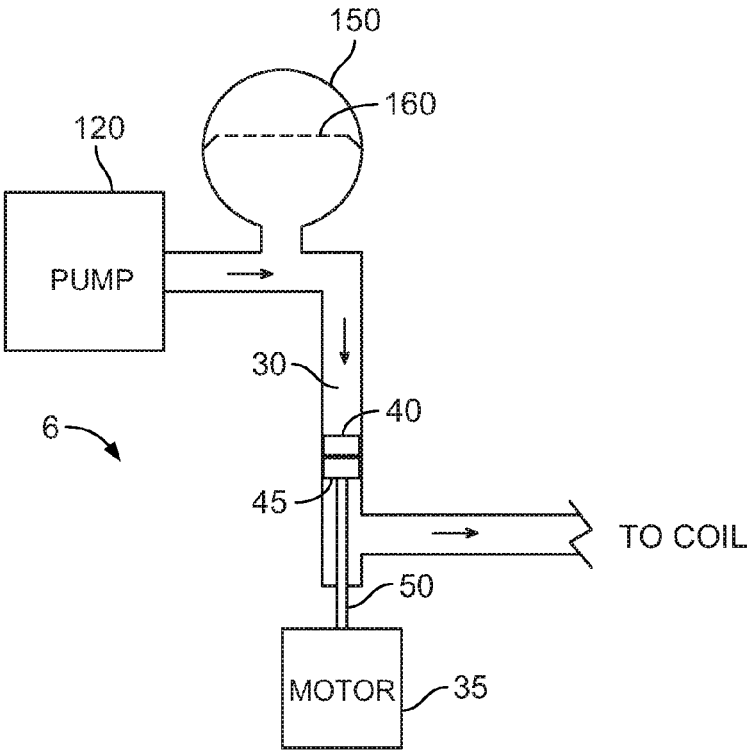
FIG. 9 illustrates a pressure altering apparatus, configured according to a fourth embodiment.

The embodiment illustrated in FIG. 8 is similar to that of FIG. 2 with the exception that all of the fluid being circulated from the fluid pump 120 travels through the valve plates 40 and 45. In an embodiment illustrated in FIG. 9, a dampening device may be provided which may contain some form of a diaphragm. For instance, the dampening device may be a "Hydril Style Dampeners." A person skilled in the art will understand that many other types of dampeners may be used as well.

Figure 10:
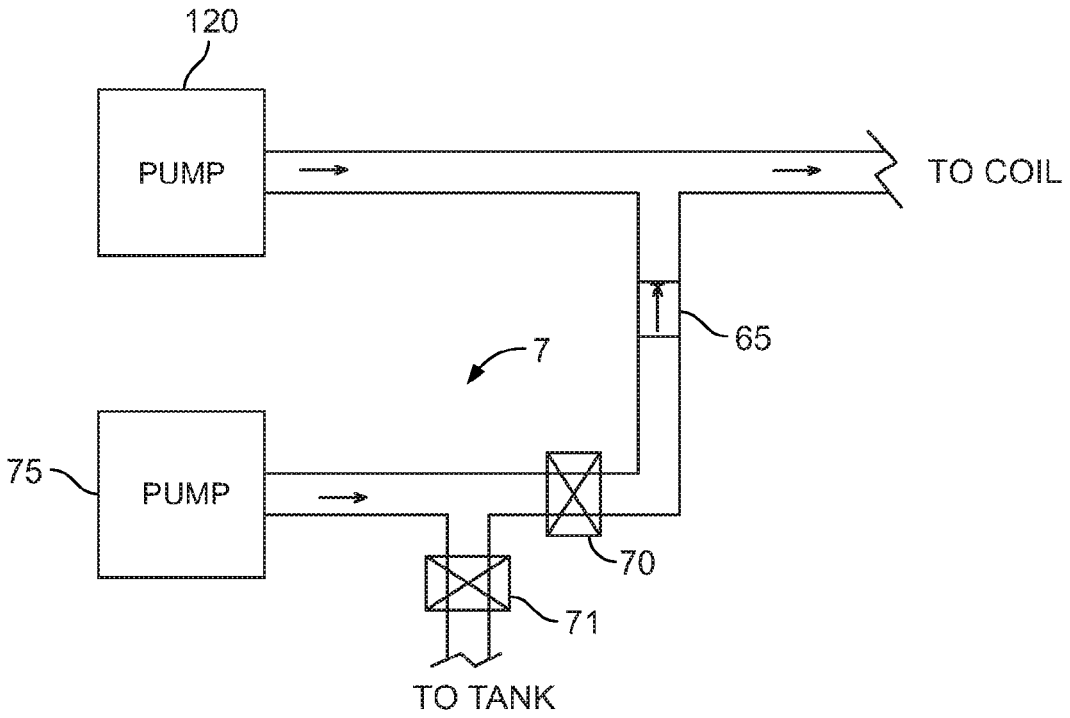
FIG. 10 illustrates a pressure altering apparatus, configured according to a fifth embodiment.

FIG. 10 shows a fifth embodiment of a pressure altering apparatus 7 that uses a second fluid pump 75 in addition to the primary fluid pump 120. The second fluid pump 75 may be similar to the primary fluid pump 120. The pressure altering apparatus may additionally include a set of valves to create pressure changes in the fluid column within the pipe string. The secondary fluid pump 75 may be any sort of duplex pump or larger, such that the pump has at least two or more plungers being used. The secondary fluid pump 75 may vary in size and flow rate from the primary fluid pump 120 in various embodiments.

As the secondary fluid pump 75 begins to circulate fluid through the pipe string, valves 70 and 71 will be intermittently opened and closed. The moment that valve 70 is opened valve 71 is closed so that little to no fluid is circulated back into the tank. All or most of the fluid traveling from the secondary fluid pump 75 travels through a check valve 65 and enters the pipe string, which causes a sudden pressure increase in the column of fluid within the bore of the pipe string. As valve 70 is closed off, valve 71 is opened so that the fluid is circulated back into the tank. This causes the pressure to then decrease within the pipe string. Check valve 65 disallows fluid being pumped from the primary fluid pump 120 from traveling to the valve 70 while it is closed off. The fluid pressure from the primary fluid pump 120 severely disrupts the pulsations in the fluid column created by valve 70 once it is reopened.

According to the embodiment, valves 70 and 71 can never be simultaneously closed off. If the flow of fluid is shut off, there will be an unsafe pressure increase within the pipe. There may be instances where the valves 70 and 71 are either completely or partially opened together, but they can never be closed off at the same moment.

The cyclical process, where there is periodic opening and closing of valves 70 and 71, provides a resulting increase and decrease of resistance to the flow of fluid through the pressure altering apparatus 7 thereby creating pulses within the fluid column in the pipe string. These pulses in the fluid column will cause the pipe string to vibrate.

Figure 11:
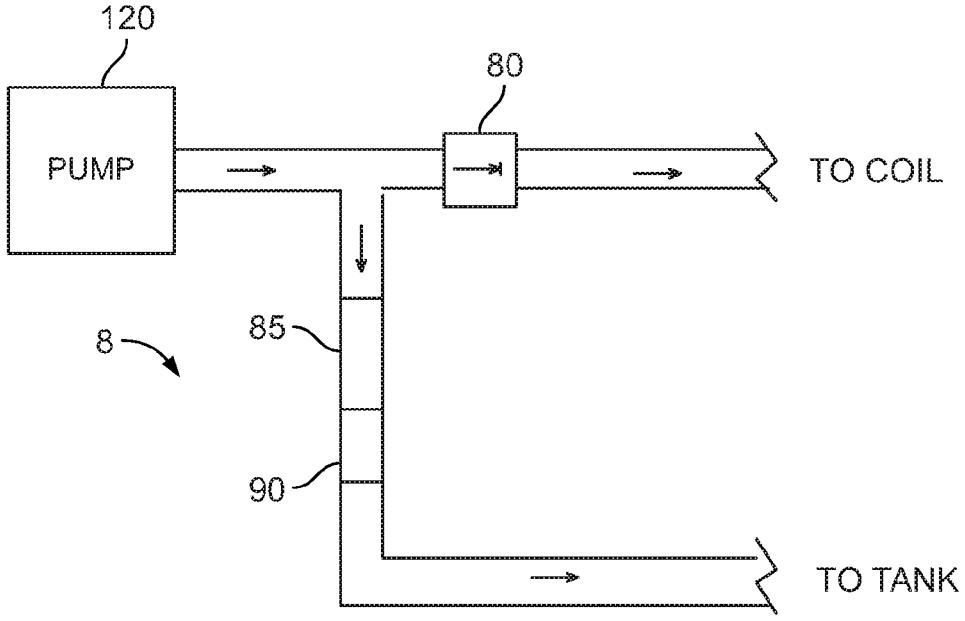
FIG. 11 illustrates a pressure altering apparatus, configured according to a sixth embodiment.

FIG. 11 illustrates a sixth embodiment of a pressure altering apparatus 8, which uses a Moineau motor 85 along with a valve 90 to create pressure pulses in the pipe string. Valve 90 will be referred to as a valve for simplicity but a skilled artisan will appreciate that the valve may be any valve or valve plate that opens and closes via rotation. Some fluid from the pump 120 will travel through check valve 80 and directly to the coil, but a portion of the fluid will travel around the check valve 80 and through the Moineau motor 85 and valve 90. The fluid travelling through the Moineau motor 85 causes rotation of a shaft within the Moineau motor 85 that will then cause rotation of the valve 90. Consequently, there will be moments that the valve 90 will be fully open, partially opened, and fully closed. At the instance where the valve is completely opened, fluid will be able to travel freely through the pressure altering apparatus 8 back to the tank. This causes a pressure decrease within the fluid column of the pipe string. As the shaft within the Moineau motor 85 continues to rotate, the valve 90 will be completely closed off, and fluid travel through the valve 90 will be blocked. This causes an increase in pressure in the fluid column of the pipe string.

The cyclical process, where there is intermittent opening and closing of valve 90 provides a resulting increase and decrease of resistance to the flow of fluid through the pressure altering apparatus 8, thereby creating pulses within the fluid column in the pipe string. These pulses in the fluid column cause the pipe string to vibrate or oscillate, and can travel the full length of the pipe string.

Figure 12:
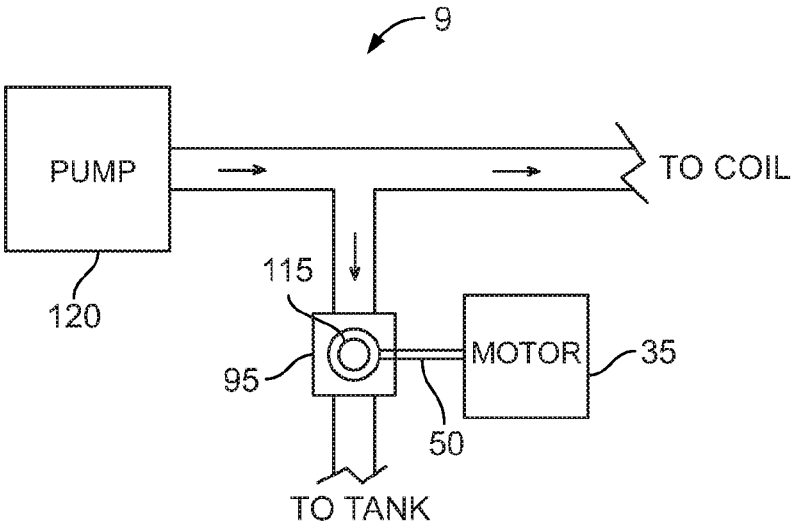
FIG. 12 illustrates a pressure altering apparatus, configured according to a seventh embodiment.

FIG. 12 shows a seventh embodiment of a pressure altering apparatus 9 that uses a motor 35 attached to a shaft 50 that rotates a ball valve 95. A portion of the fluid from the fluid pump 120 travels towards the coil, or drill string, while the remainder of the fluid travels towards the ball valve 95. The motor 35 causes rotation of the shaft 50 that in turn causes rotation of the ball valve 95. Consequently, there are instances where an opening 115 of the ball valve 95 is completely opened, partially opened, and completely closed off. The moment where the ball valve 95 is completely closed, fluid from the pump 120 is prevented from travelling back to the tank, keeping the pressure constant within the column of fluid in the pipe string. As the shaft 50 continues to rotate, the opening 115 of the ball valve 95 is fully opened, and fluid from the fluid pump 120 travels freely to the tank, which relieves pressure within the column of fluid in the pipe string.

The cyclical process of relieving the pressure through the opening 115 of the ball valve 95 results in periodic decreases of resistance to the flow of fluid through the pressure altering apparatus 9, thereby creating pulses within the fluid column in the pipe string. These pulses in the fluid column cause the pipe string to vibrate. A person possessing ordinary skill in the art will understand that the ball valve 95 may be placed in the primary fluid stream substantially regulating all of the flow from the fluid pump 120, rather than just regulating fluid in a secondary fluid stream travelling back to the tank.

Figure 13:
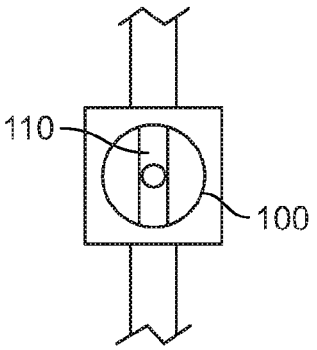
FIG. 13 is a top view of a Willamette Cone Valve that can be used in lieu of the ball valve shown in FIG. 12.
Figure 14:
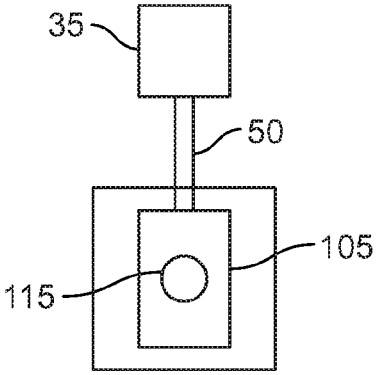
FIG. 14 is a side view of a cylindrical valve that can be used in lieu of the ball valve shown in FIG. 12.
Figure 15:
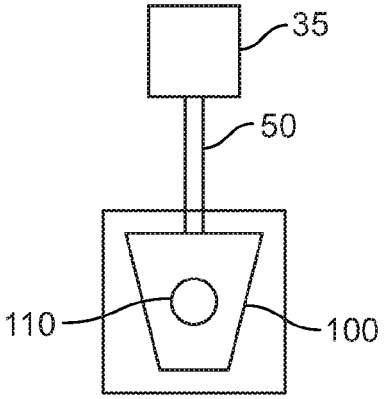
FIG. 15 is a side view of a cone valve that can be used in lieu of the valve shown in FIG. 12.

FIGS. 13-15 illustrate different examples of valves that may be used in place of the ball valve 95 in FIG. 12. FIGS. 13 and 15 represent a conical valve 100 having an opening 110 through the center. Shaft 50 of the motor 35 rotates the conical valve 100, which causes periodic opening and closing of the opening 110. FIG. 14 shows a cylindrical valve 105 having an opening 115 through the center. Shaft 50 of the motor 35 rotates the cylindrical valve 105 so that the opening 115 is intermittently opened and closed.

Figure 16:
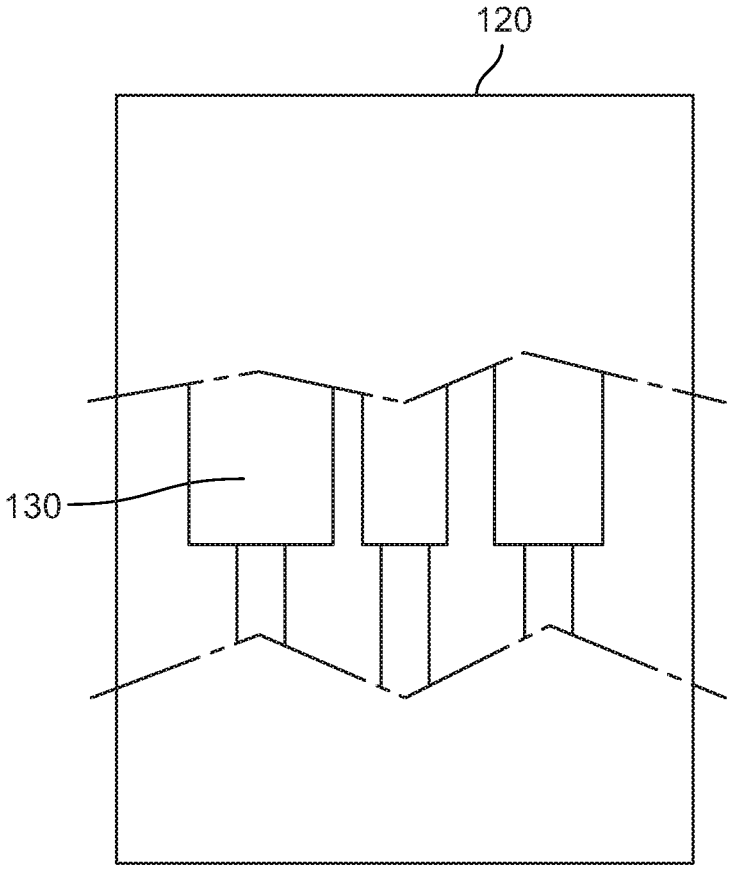
FIG. 16 is a top view of a triplex implementing varying size plungers to create pressure changes in the fluid stream.

According to other embodiments, pressure pulses may be created in the fluid column by using different sized (i.e., diameter) plungers 130 within the fluid pump 120 as shown in FIG. 16. According to the embodiment, the fluid pump 120 may have at least two or more plungers; i.e. duplex, triplex, quadplex, etc. The different diameter plungers, for the same stroke length, therefore create different fluid flow rates for the output of each plunger—i.e., the larger diameter plungers displace a larger volume of fluid and consequently result in a high fluid flow rate per stroke, than the smaller diameter plungers. The different flow rates result in different flowing fluid pressures. The increased and decreased pressures on the fluid coming from the fluid pump 120 cause vibrations throughout the pipe string.

For the purposes of promoting an understanding of the principles of the disclosure, reference has been made to the embodiments illustrated in the drawings, and specific language has been used to describe these embodiments. However, no limitation of the scope of the disclosure is intended by this specific language, and the disclosure should be construed to encompass all embodiments that would normally occur to one of ordinary skill in the art. The particular implementations shown and described herein are illustrative examples and are not intended to otherwise limit the scope of the disclosure in any way.

The steps of all methods described herein are performable in any suitable order unless otherwise indicated herein or otherwise clearly contradicted by context. The use of any and all examples, or exemplary language (e.g., "such as") provided herein, is intended merely to better illuminate the disclosure and does not pose a limitation on scope unless otherwise claimed. Numerous modifications and adaptations will be readily apparent to those skilled in this art without departing from the spirit and scope of the disclosure.

It will also be recognized that the terms "comprises," "comprising," "includes," "including," "has," and "having," as used herein, are specifically intended to be read as open-ended terms of art. The use of the terms "a" and "an" and "the" and similar referents in the context of describing the invention (especially in the context of the following claims) are to be construed to cover both the singular and the plural, unless the context clearly indicates otherwise. In addition, it should be understood that although the terms "first," "second," etc. may be used herein to describe various elements, these elements should not be limited by these terms, which are only used to distinguish one element from another.

I claim:

1. An apparatus for creating vibrations in a pipe string, the apparatus being disposed on a surface side of the pipe string, the apparatus comprising:

a fluid pump configured to pump fluid within a first fluid bore, the fluid pump being connected to the pipe string via the first fluid bore;

a hydraulic pump configured to pump fluid within a second fluid bore, wherein the second fluid bore is contiguous with a branch off of the first fluid bore along an axis;

a movable plunger disposed between the first fluid bore and the second fluid bore, and configured to alter a pressure of fluid within the first fluid bore; wherein a tank for collecting at least a portion of the fluid is connected to the apparatus via an opening in the branch of the first fluid bore; and the movement of the plunger along the axis is configured to generate vibrations within the pipe string via the first fluid bore by blocking and unblocking the opening in the branch of the first fluid bore, thereby altering the amount of fluid allowed to flow to the tank.

2. The apparatus of claim 1, wherein when the pressure from the hydraulic pump increases, the plunger is configured to move towards the fluid pump to block the opening in the branch of the first fluid bore to disallow a portion of the fluid to flow to the tank; and when the pressure from the hydraulic pump decreases, the plunger is configured to move away from the fluid pump to unblock the opening in the branch of the first fluid bore allow the fluid to flow to the tank.

3. The apparatus of claim 1, wherein the plunger is sealed within the first fluid bore such that fluid within the first fluid bore does not contact the fluid within the second fluid bore.

4. The apparatus of claim 1, further comprising a piston connected to the plunger, wherein fluid pumped by the hydraulic pump applies pressure on the piston to move the plunger in a direction towards the fluid pump or away from the hydraulic pump.

5. The apparatus of claim 4 wherein the piston comprises a hydraulic cylinder.

6. A method for generating vibrations in a pipe string via a pressure altering apparatus positioned at a surface side of the pipe string, the method comprising:

pumping fluid within a first fluid bore via a fluid pump of the pressure altering apparatus, the fluid pump being connected to the pipe string via the first fluid bore;

pumping fluid within a second fluid bore via a hydraulic pump of the pressure altering apparatus, wherein the second fluid bore is contiguous with a branch off of the first fluid bore along an axis; and altering a pressure within the first fluid bore by moving a plunger disposed between the first fluid bore and the second fluid bore, wherein the movement of the plunger along the axis controls a flow of fluid within the first fluid bore to a tank; and generating vibrations within the pipe string by controlling the movement of the plunger to block and unblock an opening in the branch of the first fluid bore, wherein the opening leads to the tank.

7. The method of claim 6, wherein the movement of the plunger is controlled by altering a volume of fluid pumped by the hydraulic pump.

8. The method of claim 6, further comprising:

moving the plunger towards the fluid pump to block the opening in the branch of the first fluid bore to the tank in order to disallow a portion of the fluid to flow to the tank when a fluid pressure from the hydraulic pump increases; and moving the plunger away from the fluid pump to unblock the opening in the branch of the first fluid bore to the tank in order to allow the fluid to flow to the tank when a fluid pressure from the hydraulic pump decreases.

9. The method of claim 6, further comprising:

sealing the plunger within the first fluid bore such that fluid within the first bore does not contact the fluid within the second fluid bore.

* * * * *